US007186931B2

(12) United States Patent
Chang et al.

(10) Patent No.: US 7,186,931 B2
(45) Date of Patent: Mar. 6, 2007

(54) BUTTON FASTENING DEVICE WITH CIRCUIT ACTUATING CAPABILITY

(75) Inventors: Han-Chao Chang, Tainan (TW); Jen-Lin Chen, 11648 Birch Spring Ct., Cupertino, CA (US) 95014

(73) Assignee: Jen-Lin Chen, Cupertino, CA (US)

( * ) Notice: Subject to any disclaimer, the term of this patent is extended or adjusted under 35 U.S.C. 154(b) by 0 days.

(21) Appl. No.: 11/204,500

(22) Filed: Aug. 15, 2005

(65) Prior Publication Data

US 2006/0283691 A1 Dec. 21, 2006

(30) Foreign Application Priority Data

Jun. 17, 2005 (TW) ..... 94120240 A

(51) Int. Cl.
*H01H 9/26* (2006.01)

(52) U.S. Cl. ..... 200/5 A; 200/43.11

(58) Field of Classification Search ..... 200/5 A, 200/61.58 R, 43.11, 43.18, 43.19, 912–914; 2/912–914

See application file for complete search history.

(56) References Cited

U.S. PATENT DOCUMENTS 6,642,467 B2 11/2003 Farringdon
6,848,808 B2 * 2/2005 Guerrieri ..... 362/156
2006/0021684 A1 * 2/2006 DeCoro, III ..... 150/105
2006/0146521 A1 * 7/2006 Despeines ..... 362/155

FOREIGN PATENT DOCUMENTS

BE 1014106 A3 4/2003
DE 4433469 A1 3/1996

OTHER PUBLICATIONS

Patents Act 1977: Combined Search and Examination Report under Sections 17 and 18(3) for GB0516966.9 dated Oct. 14, 2005.

* cited by examiner

*Primary Examiner*—Michael Friedhofer
*Assistant Examiner*—Lisa Klaus

(57) ABSTRACT

A button fastening device with circuit actuating capability includes: a first button part; a second button part engageable releasably with the first button part for fastening articles together; and a circuit actuating unit mounted on at least one of the first and second button parts, adapted to be electrically connected to a circuit, and operable to control circuit states of the circuit through engagement and disengagement of the first and second button parts.

14 Claims, 13 Drawing Sheets

BUTTON FASTENING DEVICE WITH CIRCUIT ACTUATING CAPABILITY

CROSS-REFERENCE TO RELATED APPLICATION

This application claims priority of Taiwanese application no. 094120240, filed on Jun. 17, 2005.

BACKGROUND OF THE INVENTION

1. Field of the Invention

This invention relates to a button fastening device with circuit actuating capability, more particular to a button fastening device with a circuit actuating unit for controlling circuit states of a circuit.

2. Description of the Related Art

Conventional button fastening devices normally include a first button part and a second button part that is engageable with the first button part so as to fasten articles together. The button fastening devices can be used on articles, such as cloths, bags, toys, shoes, etc.

The conventional button fastening devices are disadvantageous in that they are unattractive and lack functionality.

SUMMARY OF THE INVENTION

Therefore, the object of the present invention is to provide a button fastening device that includes a circuit actuating unit so as to overcome the aforesaid drawbacks of the prior art.

Another object of the present invention is to provide a button fastening device that includes first and second button parts and a pair of conductive terminals which are electrically connected to each other when the first and second button parts engage with each other.

Yet another object of the present invention is to provide a button fastening device-and-circuit assembly that includes the button fastening device and a circuit activated and deactivated through engagement and disengagement of first and second button parts of the button fastening device.

According to one aspect of the present invention, there is provided a button fastening device with circuit actuating capability. The button fastening device comprises: a first button part; a second button part engageable releasably with the first button part for fastening articles together; and a circuit actuating unit provided on at least one of the first and second button parts, adapted to be electrically connected to a circuit, and operable to control circuit states of the circuit through engagement and disengagement of the first and second button parts.

According to another aspect of the present invention, there is provided a button fastening device that comprises: a first button part; a second button part engageable magnetically with the first button part for fastening articles together; and a pair of conductive terminals provided respectively on the first and second button parts and adapted to be electrically coupled to a circuit. The conductive terminals are electrically connected to each other when the first button part engages magnetically the second button part, thereby activating the circuit.

According to yet another aspect of the present invention, there is provided a button fastening device-and-circuit assembly that comprises: a button fastening device including a first button part, and a second button part engageable releasably with the first button part for fastening articles together; and a circuit. The first and second button parts are coupled to the internal circuit in such a manner that circuit states of the internal circuit are controlled through engagement and disengagement of the first and second button parts.

BRIEF DESCRIPTION OF THE DRAWINGS

In drawings which illustrate embodiments of the invention.

DETAILED DESCRIPTION OF THE PREFERRED EMBODIMENTS

Figure 1:
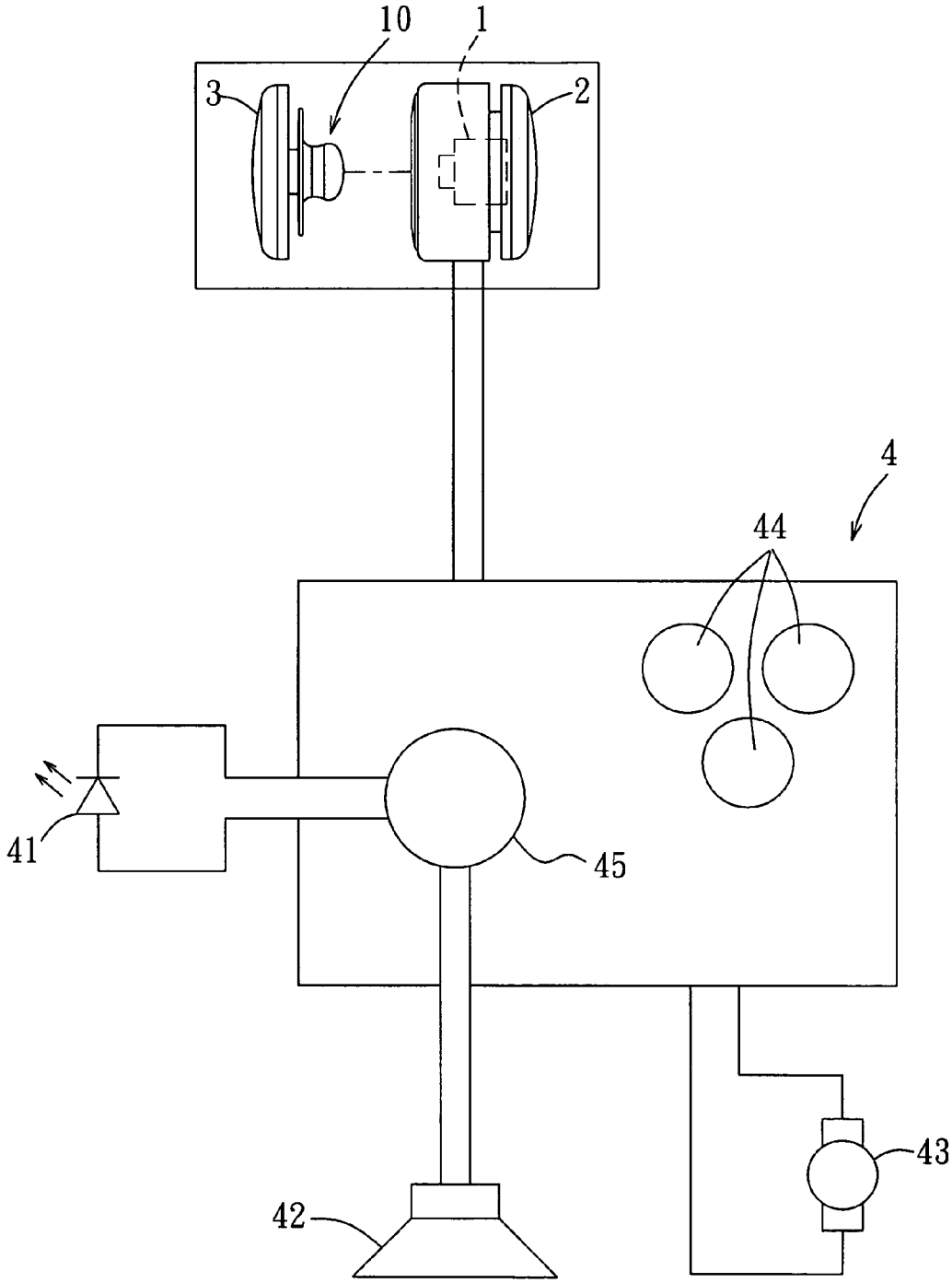
FIG. 1 is a schematic view of the first preferred embodiment of a button fastening device according to this invention, illustrating how the preferred embodiment is used to control a circuit.
Figure 2:
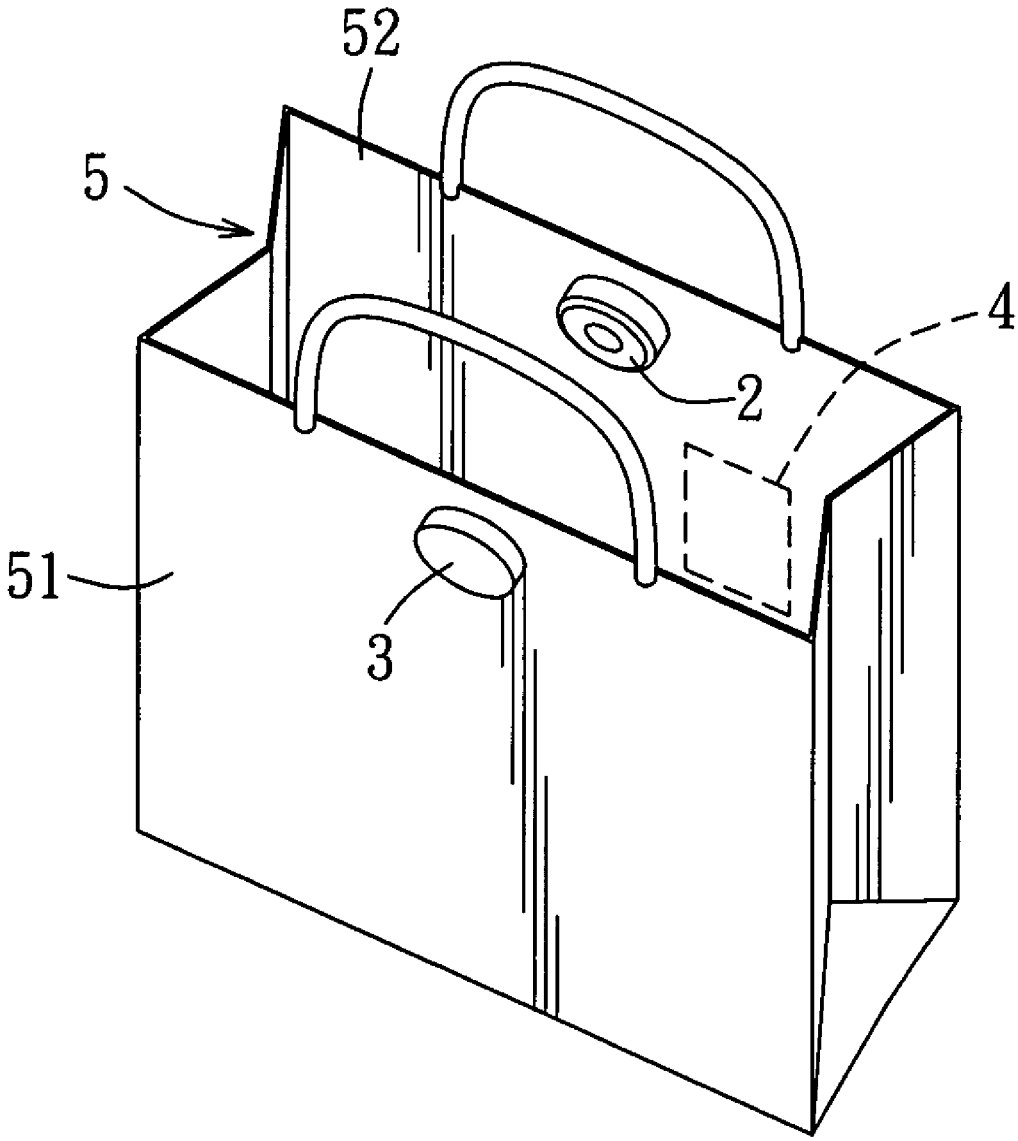
FIG. 2 is a perspective view to illustrate how the first preferred embodiment together with the circuit is used on a bag.

Before the present invention is described in greater detail, it should be noted that same reference numerals have been used to denote like elements throughout the specification. Moreover, the term "circuit actuating unit" used in this application is hereinafter referred to as means that comprise at least two conductive members which are capable of being disposed at a contacting state or in a separated state for activating or deactivating a circuit.

FIGS. 1 to 4 illustrate the first preferred embodiment of a button fastening device with circuit actuating capability according to the present invention for fastening articles, such as two opposite walls 51, 52 of a bag 5 (see FIG. 2), together.

The button fastening device includes: a first button part 2; a second button part 3 engageable releasably with the first button part 2 for fastening the walls 51, 52 together; and a circuit actuating unit 1 mounted on at least one of the first and second button parts 2, 3 adapted to be electrically connected to an external circuit 4, and operable to control circuit states of the external circuit 4 through engagement and disengagement of the first and second button parts 2, 3.

In this embodiment, the circuit actuating unit 1 includes first and second conductive members 32 that are spaced apart from each other, that are connected to the external circuit 4, and is operable through engagement and disengagement of the first and second button parts 2, 3 to control electrical connection and disconnection between the first and second conductive members 32.

Figure 7:
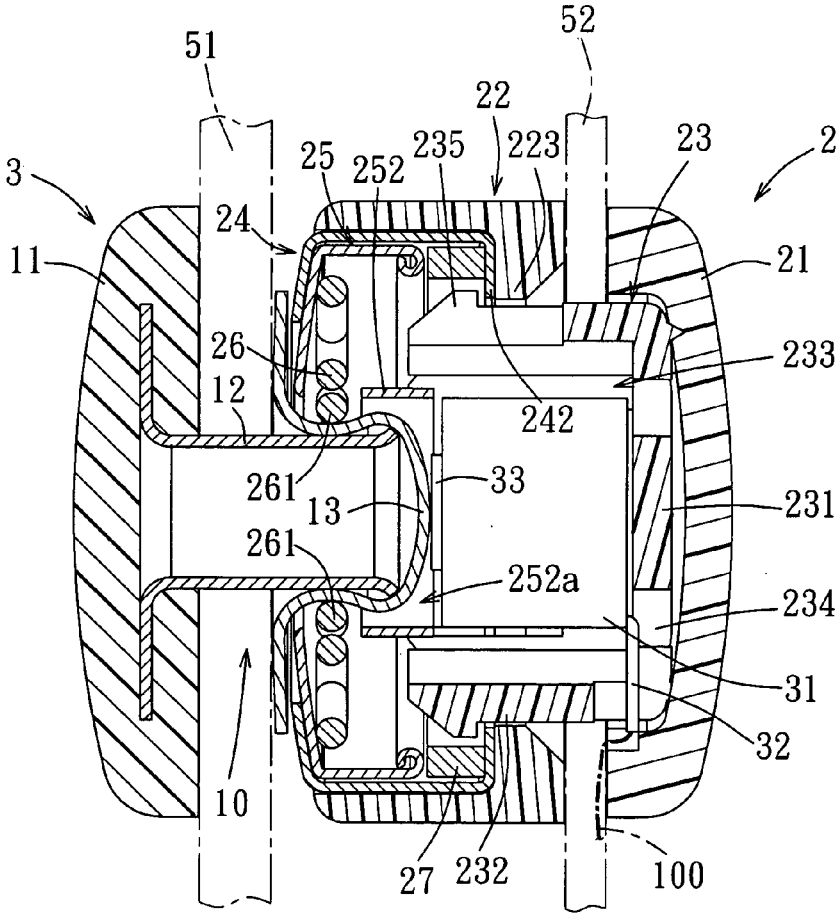
FIG. 7 is a sectional view of the first preferred embodiment, illustrating another state where the first and second button parts of the button fastening device of the first preferred embodiment engage each other.

The first button part 2 defines an inner space 20 therein. The first and second conductive members 32 are mounted in the inner space 20. The second button part 3 has a protrusion 10 that is associated with the first and second conductive members 32 in such a manner that extension of the protrusion 10 into the inner space 20 (see FIG. 7) and removal of the protrusion 10 from the inner space 20 (see FIG. 4) enable electrical connection and disconnection between the first and second conductive members 32.

In this embodiment, the circuit actuating unit 1 is in the form of a switch. The switch has a casing 31 and a pressable button 33 that is mounted movably on the casing 31. Each of the first and second conductive members 32 is in the form of a terminal mounted on the casing 31. The conductive members 32 are electrically connected to each other through the pressable button 33 when the pressable button 33 is disposed at a normal position, i.e., when the first and second button parts 2, 3 are disengaged from each other. The pressable button 33 is pressed by the protrusion 10 of the second button part 3 (see FIG. 7) to disconnect the first and second conductive members 32 when the second button part 3 engages the first button part 2, thereby enabling the circuit 4 to be disposed at a circuit state, i.e., an OFF (passive) state. The pressable button 33 is restored to its normal position when the second button part 3 is disengaged from the first button part 2, thereby switching the external circuit 4 to another circuit state, i.e., an ON (active) state.

Figure 3A:
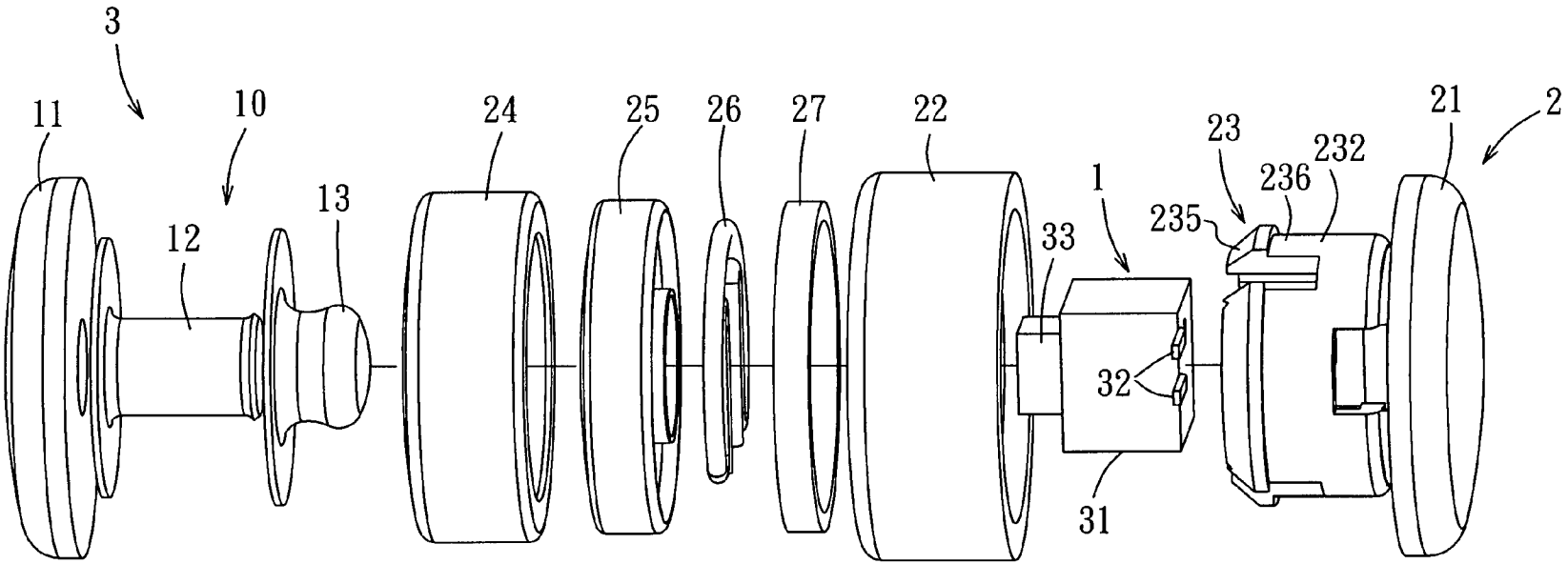
FIG. 3A is an exploded perspective view of the first preferred embodiment.
Figure 3D:
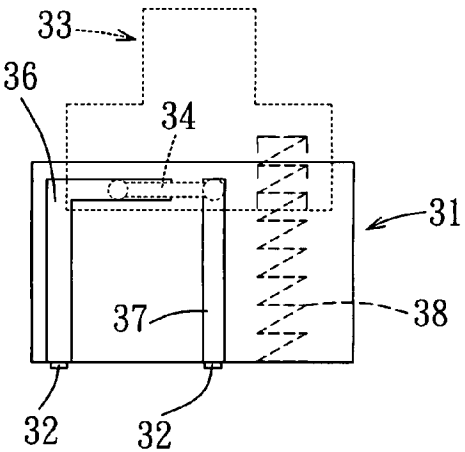
FIGS. 3B to 3D are schematic views to illustrate how a pressable button of the first preferred embodiment is operated to activate or deactivate a circuit.
Figure 3C:
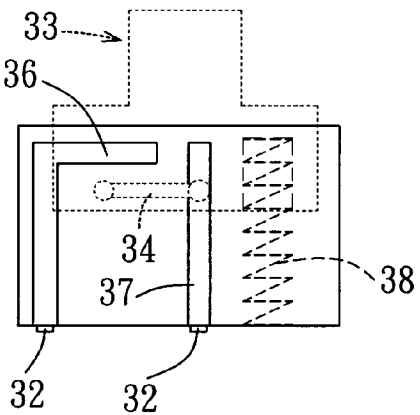
Figure 3B:
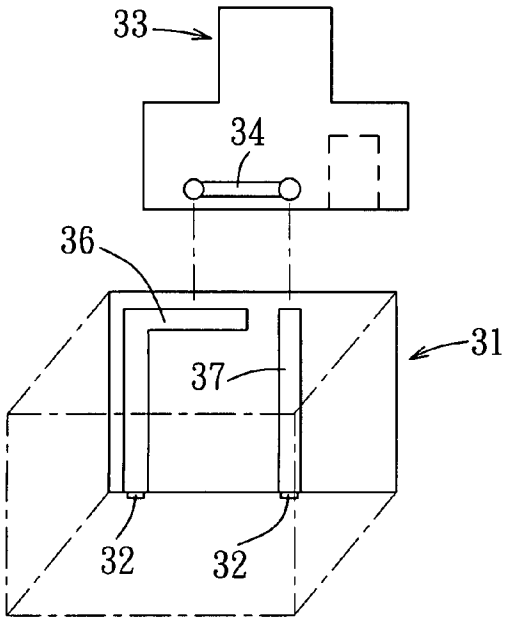

FIGS. 3B to 3D illustrate the structure of the switch of the circuit actuating unit 1 used in this preferred embodiment. The pressable button 33 has a first conductive strip 34 mounted therein. The switch further includes a pair of spaced apart second conductive strips 36, 37 mounted in a switch housing 31 and connected to the conductive members 32, respectively, and an urging member 38 mounted in the switch housing 31 for urging the pressable button 33 to its normal position. When the pressable button 33 is pressed (see FIG. 3C), the first conductive strip 34 is separated from one of the second conductive strips 36, 37, thereby disconnecting the conductive members 32 from each other, while when the pressable button 33 is not pressed and is disposed at its normal position (see FIG. 3D), the first conductive strip 34 interconnects the second conductive strips 36, 37, thereby establishing electrical connection between the conductive members 32.

The first button part 2 is provided with a retaining member 26 that is mounted in the inner space 20 and that includes a pair of opposite spring arms 261. The protrusion 10 of the second button part 3 is resiliently clamped by the spring arms 261 (see FIG. 7) when the second button part 3 engages the first button part 2.

Figure 4:
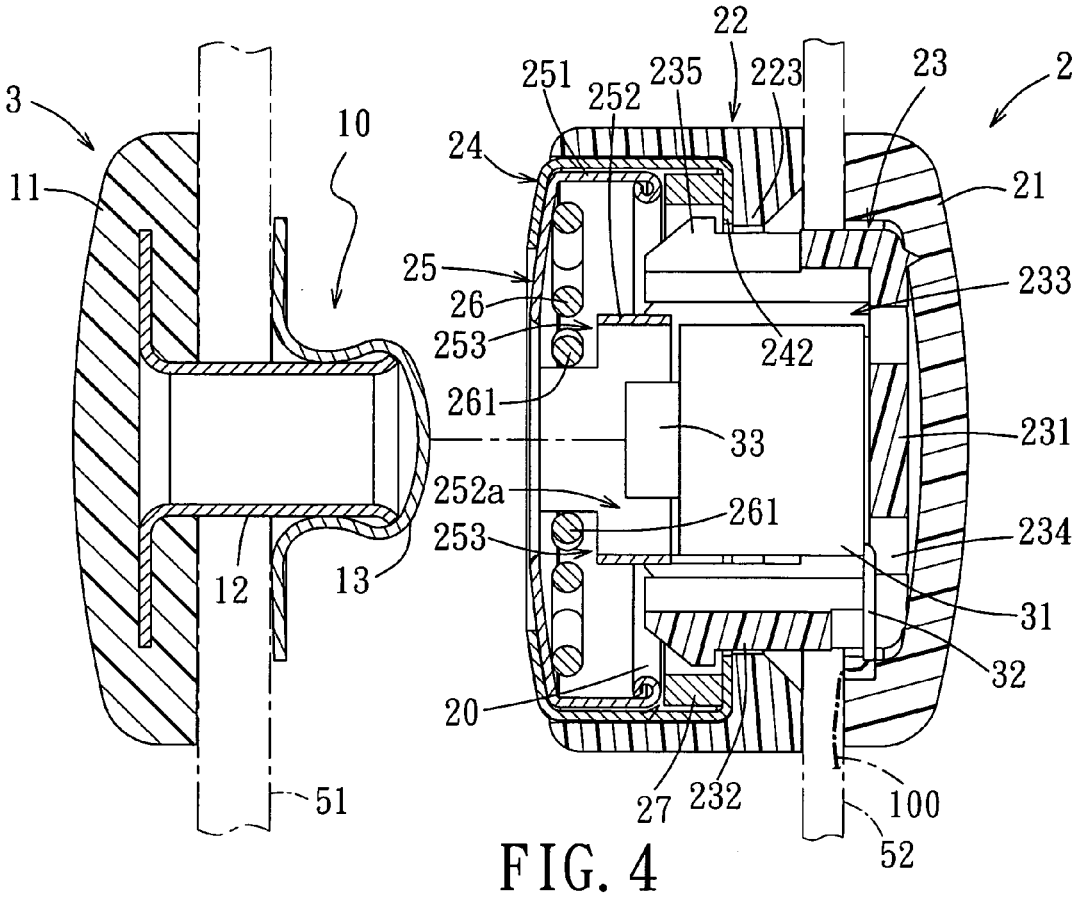
FIG. 4 is a sectional view of the first preferred embodiment, illustrating a state where first and second button parts of the button fastening device of the first preferred embodiment are disengaged from each other.

Referring to FIGS. 3A and 4, the first button part 2 includes a first disc 21, a cylindrical controller-mounting member 23 extending coaxially from the first disc 21 for receiving the circuit actuating unit 1 therein, an inner sleeve 24 in snap engagement with the controller-mounting member 23 and cooperating with the controller-mounting member 23 to define the inner space 20 therebetween, an annular retainer-mounting member 25 mounted in the inner sleeve 24 for receiving the retaining member 26 therein, and an outer sleeve 22 sleeved on the inner sleeve 24 and having an end flange 223 anchored on an end flange 242 of the inner sleeve 24 so as to prevent undesired removal of the controller-mounting member 23 from the inner sleeve 24. A spacer 27 is disposed between one end of the retainer-mounting member 25 and the end flange 242 of the inner sleeve 24 for preventing undesired axial movement of the retainer-mounting member 25 relative to the inner sleeve 24. The wall 52 of the bag 5 is sleeved on the controller-mounting member 23, and is clamped between an end face of the first disc 21 and an end face of the end flange 223 of the outer sleeve 22.

The second button part 3 further includes a second disc 11. The protrusion 10 is anchored in the second disc 11, and has a stem portion 12 and a free end portion extending from the stem portion 12 and provided with a cap 13 thereon. The wall 51 of the bag 5 is sleeved on the stem portion 12 of the protrusion 10, and is clamped between an end face of the second disc 11 and an end face of the cap 13.

Figure 5:
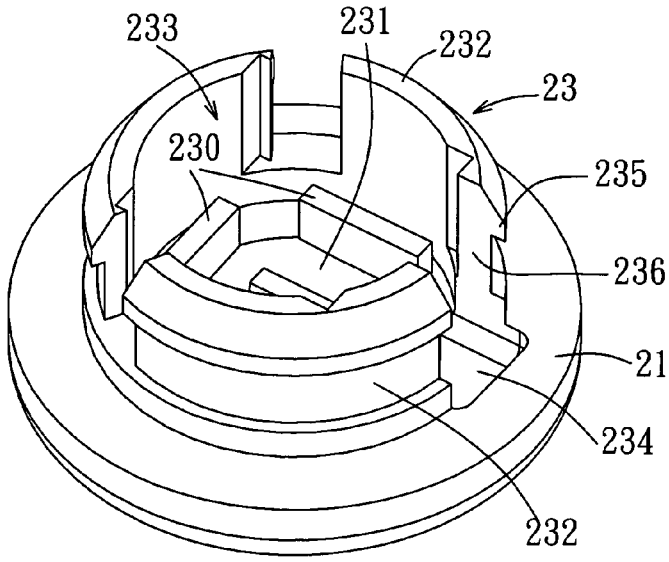
FIG. 5 is a perspective view of a controller-mounting member of the button fastening device of the first preferred embodiment.

Referring to FIG. 4, in combination with FIG. 5, the controller-mounting member 23 has a base wall 231 and a cylindrical peripheral wall 232 that extends from the base wall 231 and that defines an accommodating space 233 for receiving the circuit actuating unit 1 therein, and that is formed with a plurality of axially extending grooves and flexible tabs 236 which are alternately disposed with the extending grooves. Each of the flexible tabs 236 has a free hooked end 235 that is capable of snap engagement with the end flange 242 of the inner sleeve 24.

Figure 6:
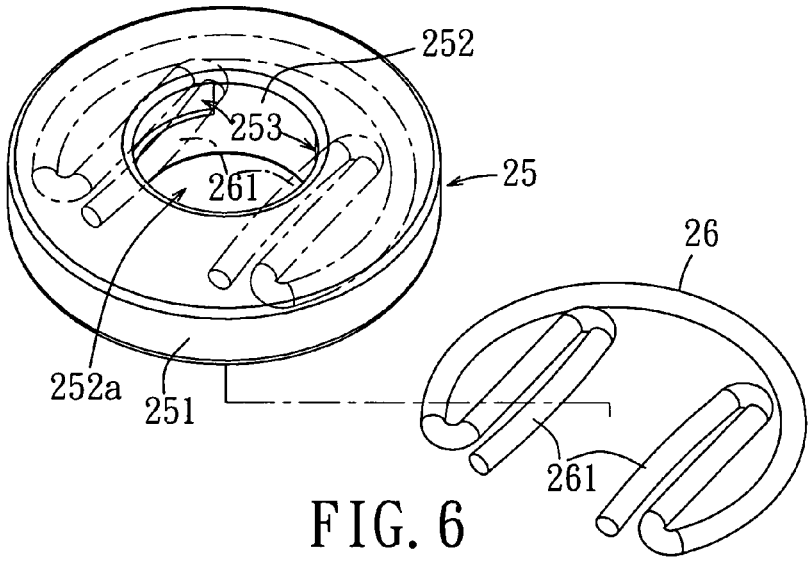
FIG. 6 is an exploded perspective view of an assembly of a retaining member and a retainer-mounting member of the button fastening device of the first preferred embodiment.

Referring to FIG. 4, in combination with FIG. 6, the retainer-mounting member 25 has an annular outer wall 251, and an annular inner wall 252 surrounded by and cooperating with the outer wall 251 to define a gap for receiving the retaining member 26 therein. The inner wall 252 defines a passage 252*a*, and is formed with a pair of opposite openings 253 that permit spatial communication between the passage 252*a* and the gap. The spring arms 261 of the retaining member 26, which is mounted in the gap, extend respectively through the openings 253 into the passage 252*a* so that the protrusion 10 of the second button part 3 can be clamped by the spring arms 261 when passed through the passage 252*a* into the inner space 20.

Referring back to FIGS. 4 and 5, the controller-mounting member 23 is formed with a through-hole 234 extending from the base wall 231 to the peripheral wall 232 for passage of a wire 100 therethrough so as to permit connection of the first and second conductive members 32 to the circuit 4 (see FIG. 1) through the wire 100. A plurality of retaining ribs 230 are formed on the base wall 231 for mounting of the circuit actuating unit 1.

The external circuit 4 actuated by the button fasting device is attached to the wall 52 of the bag 5, and can include an integrated circuit 45, an LED 41, and a speaker 42. A plurality of batteries 44 are used for providing power to the external circuit 4. The external circuit 4 may further include a motor 43 and other electronic components for providing various functions to the bag 5 so as to increase attractiveness and consumer appeal of the bag 5.

Figure 8:
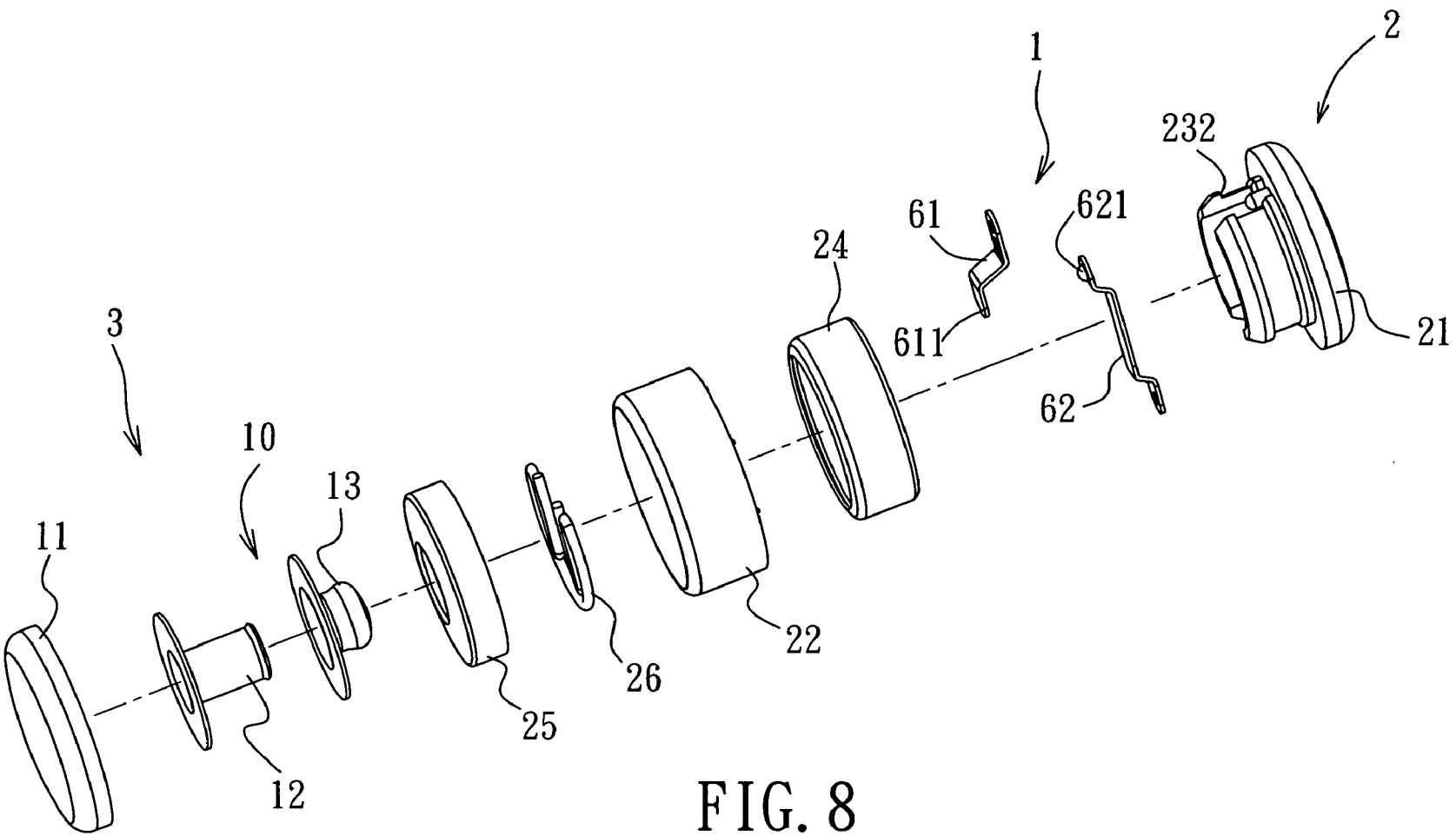
FIG. 8 is an exploded perspective view of the second preferred embodiment of the button fastening device according to this invention.

FIG. 8 illustrates the second preferred embodiment of the button fastening device according to this invention. The button fastening device of this embodiment differs from the first preferred embodiment in the structure and operation of the circuit actuating unit 1. In this embodiment, each of the first and second conductive members 61, 62 is in the form of an elongated bent plate. The first conductive member 61 is fixed to the first disc 21, and has a contact end 611. The second conductive member 62 is fixed to the first disc 21, and has a free end 621 that is aligned and that is in contact with the contact end 611 of the first conductive member 61 and that is resilient so as to be moved away from the contact end 611 of the first conductive member 61 when pressed by the protrusion 10 of the second button part 3 upon engagement between the first and second button parts 2, 3.

Figure 9:
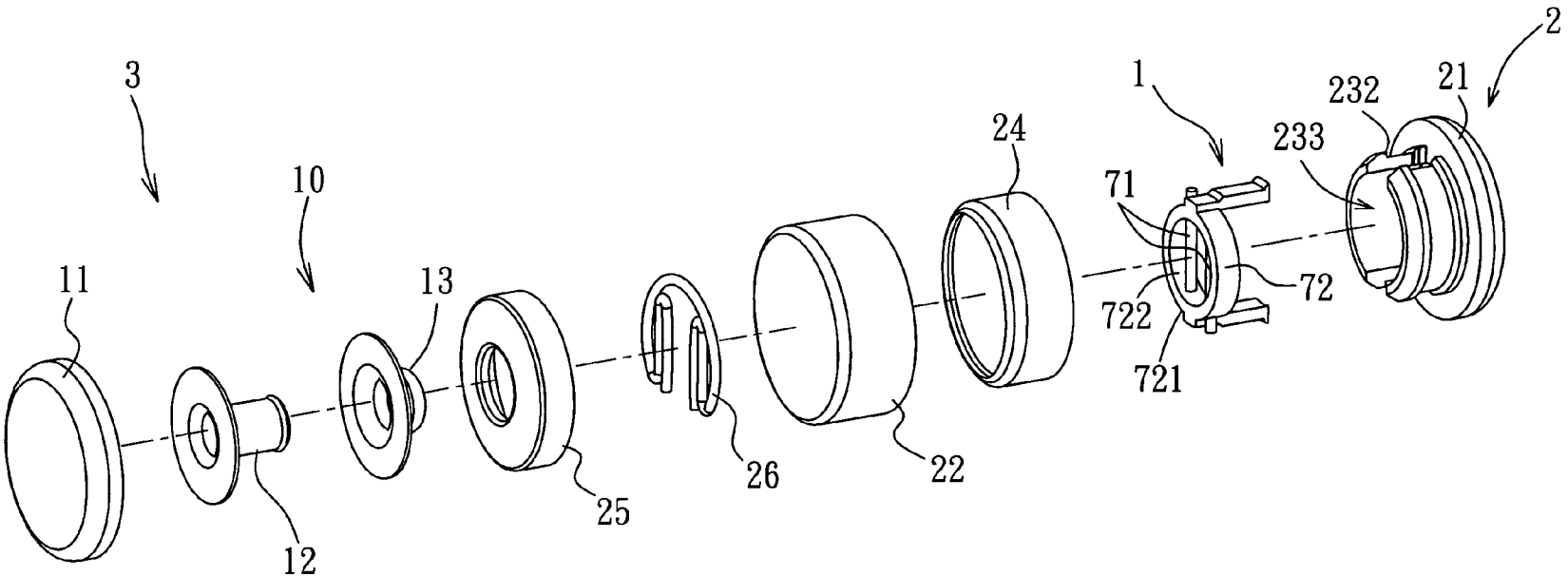
FIG. 9 is an exploded perspective view of the third preferred embodiment of the button fastening device according to this invention.

FIG. 9 illustrates the third preferred embodiment of the button fastening device according to this invention. The button fastening device of this embodiment differs from the first preferred embodiment in the structure and operation of the circuit actuating unit 1 that is mounted in the first button part 2. In this embodiment, the cap 13 is conductive. The first and second conductive members 71 are spaced apart from each other. Each of the first and second conductive members 71 is in the form of a wire. The conductive cap 13 contacts the first and second conductive members 71 to establish electrical connection therebetween when the second button part 3 engages the first button part 2.

The circuit actuating unit 1 further includes a wire-mounting seat 72 that is secured to the first disc 21, that is mounted in the inner space 20, and that has a ring 721 defining a ring-circled space 722. Each of the first and second conductive members 71 is supported on the ring 721, and has a portion disposed in the ring-circled space 722. The conductive cap 13 extends into the ring-circled space 722 to contact the portions of the first and second conductive members 71 when the second button part 3 engages the first button part 2.

Figure 10:
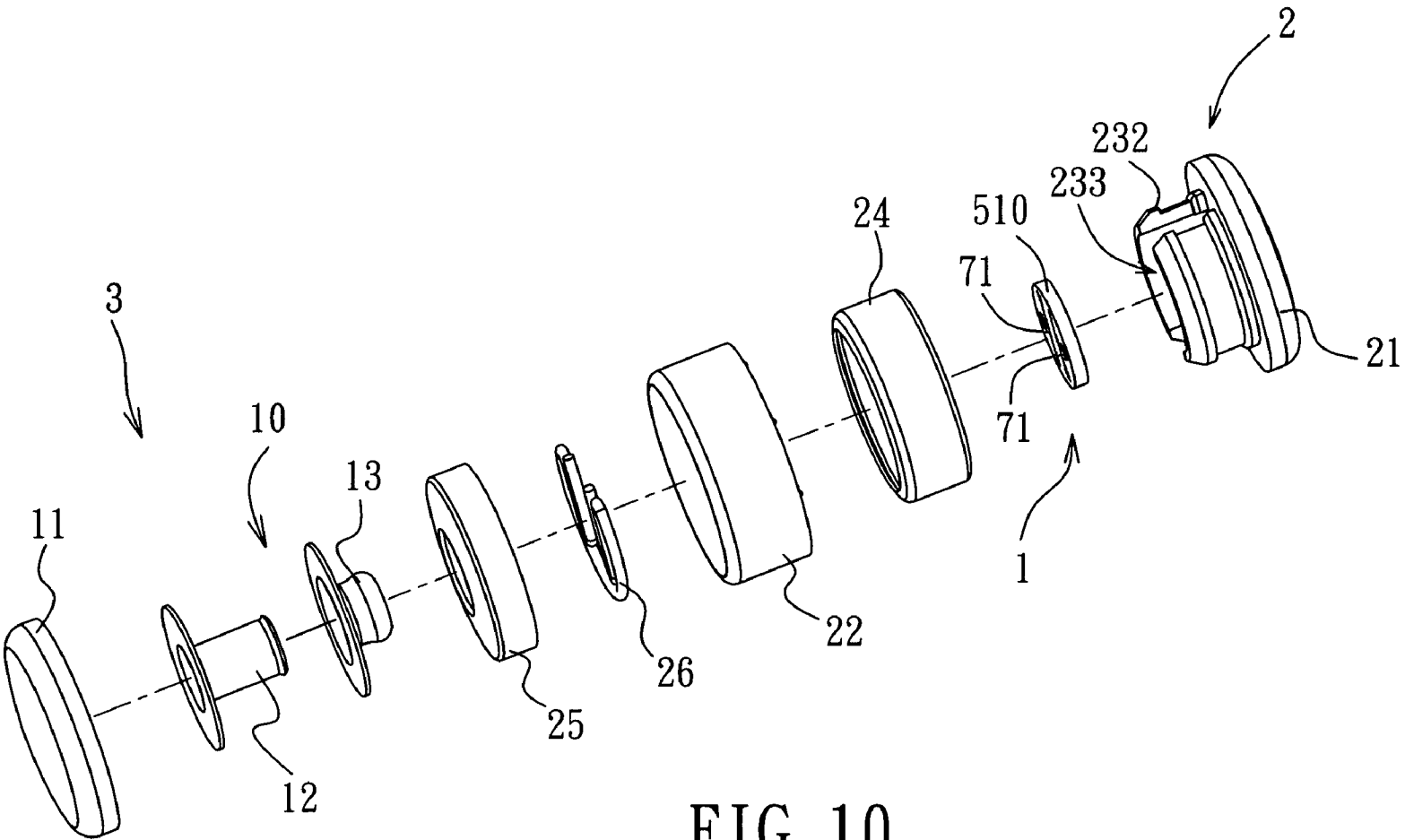
FIG. 10 is an exploded perspective view of the fourth preferred embodiment of the button fastening device according to this invention.

FIG. 10 illustrates the fourth preferred embodiment of the button fastening device according to this invention. The button fastening device of this embodiment differs from the third preferred embodiment in the structure of the circuit actuating unit 1. In this embodiment, the circuit actuating unit 1 includes a circuit board 510 that is mounted in the inner space 20. Each of the first and second conductive members 71 is in the form of a conductive trace that is printed on the circuit board 510. The conductive cap 13 extends to the circuit board 510 to contact the first and second conductive members 71 when the second button part 3 engages the first button part 2.

Figure 11:
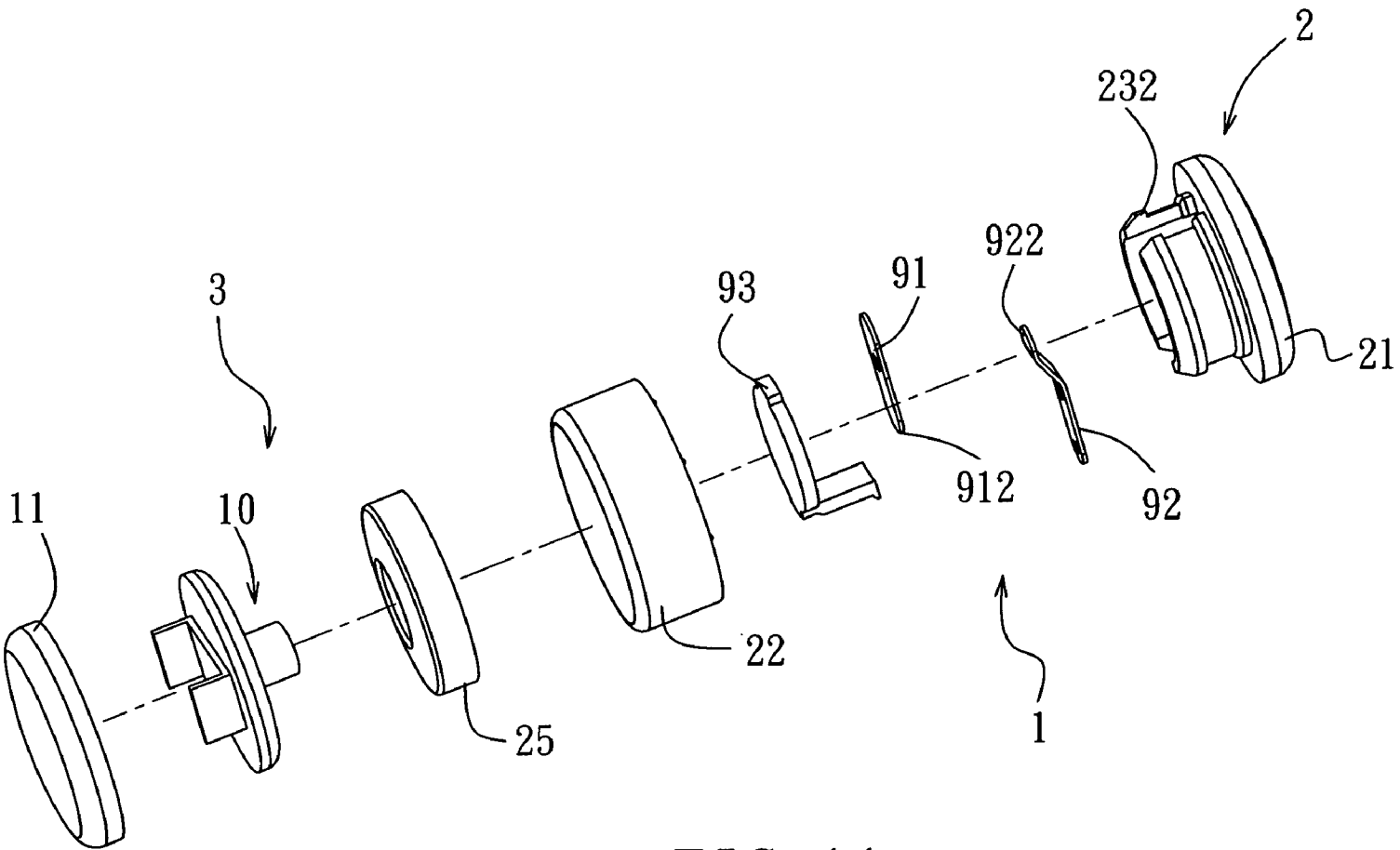
FIG. 11 is an exploded perspective view of the fifth preferred embodiment of the button fastening device according to this invention.

FIG. 11 illustrates the fifth preferred embodiment of the button fastening device according to this invention. The button fastening device of this embodiment differs from the first preferred embodiment in the structure and operation of the circuit actuating unit 1. In this embodiment, the protrusion 10 is magnetic. The first and second conductive members 91, 92 are spaced apart from each other. Each of the first and second conductive members 91, 92 is in the form of an elongated bent plate. The first conductive member 91 is fixed to a mounting seat 93, and has a contact end 912. The second conductive member 92 is fixed to the first disc 21, and has a free end 922 that is aligned with the contact end 912 of the first conductive member 91 and that is resilient. The free end 922 of the second conductive member 92 is magnetically attracted by the protrusion 10 of the second button part 3 and is thereby flexed to contact the contact end 912 of the first conductive member 91 when the protrusion 10 of the second button part 3 extends into the first button part 2 (not shown).

Figure 12:
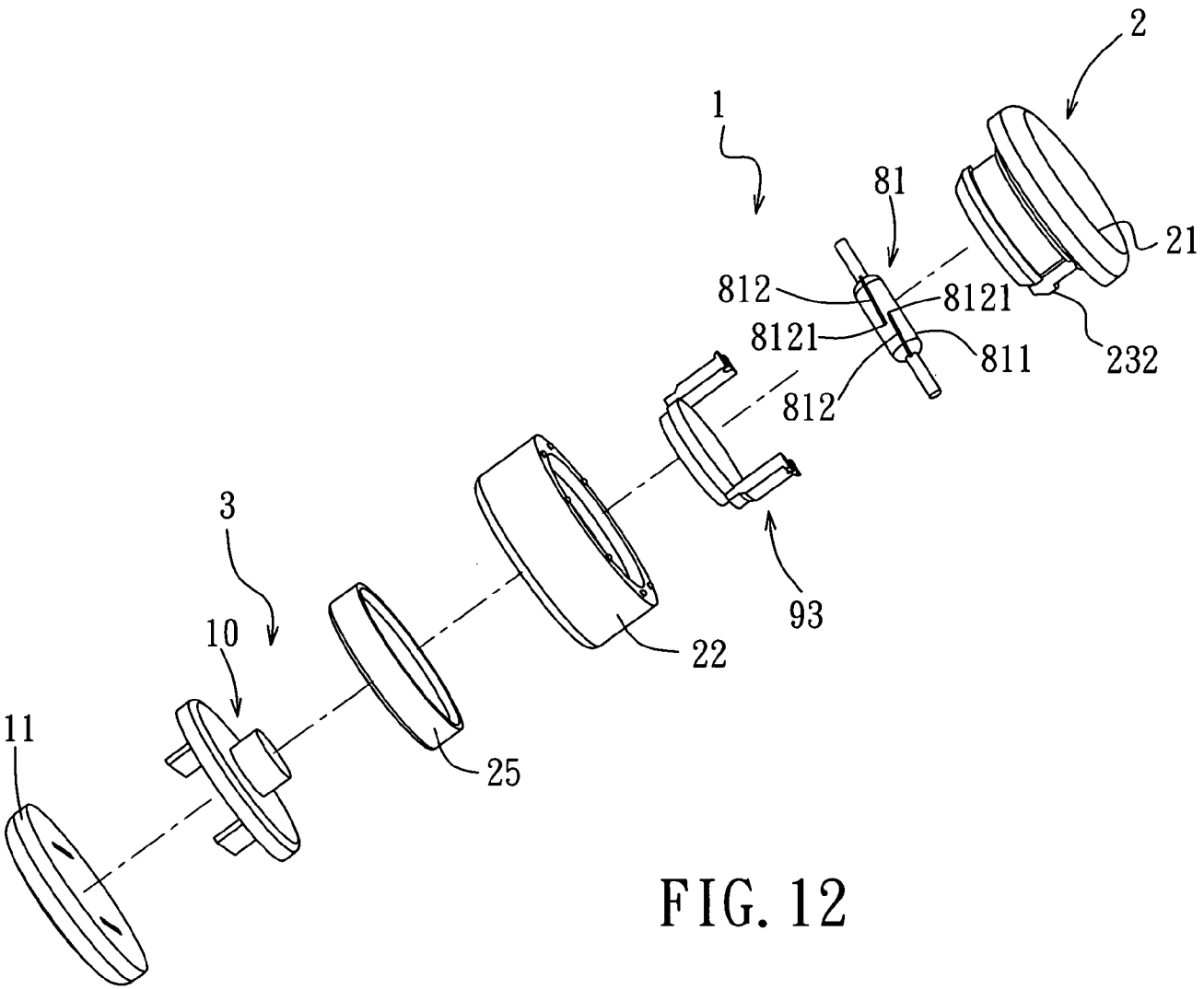
FIG. 12 is an exploded perspective view of the sixth preferred embodiment of the button fastening device according to this invention.

FIG. 12 illustrates the sixth preferred embodiment of the button fastening device according to this invention. The button fastening device of this embodiment differs from the fifth preferred embodiment in the structure of the circuit actuating unit 1. In this embodiment, the circuit actuating unit 1 is in the form of a reed switch 81. The reed switch 81 is mounted on a mounting seat 93, and has a tube 811. Each of the first and second conductive members 812 is in the form of a reed, extends into the tube 811, and has a contact end 8121. The contact ends 8121 of the first and second conductive members 812 are magnetized, and attract each other to establish contact therebetween upon extension of the protrusion 10 into the inner space 20 when the second button part 3 engages the first button part 2.

Figure 13:
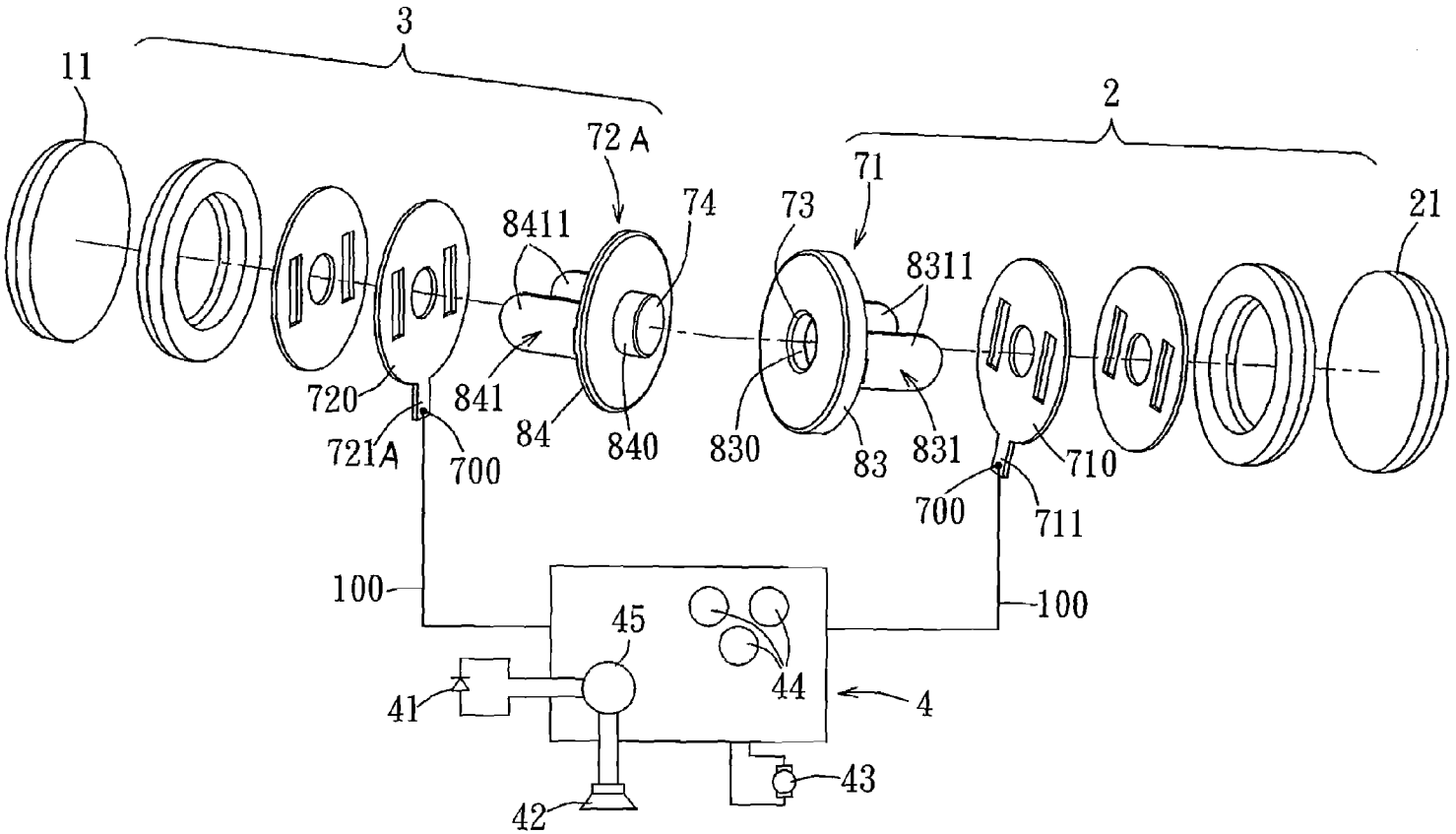
FIG. 13 is an exploded perspective view of the seventh preferred embodiment of the button fastening device according to this invention.

FIG. 13 illustrates the seventh preferred embodiment of the button fastening device according to this invention. The button fastening device includes: a first button part 2; a second button part 3 engageable magnetically with the first button part 2 for fastening articles together; and a pair of conductive terminals 711, 721 provided respectively on the first and second button parts 2, 3 and adapted to be electrically coupled to an external circuit 4. The conductive terminals 711, 721 are electrically connected to each other when the first button part 2 engages magnetically the second button part 3, thereby activating the external circuit 4.

In this embodiment, the external circuit 4 includes an integrated circuit 45, an LED 41, a speaker 42, and a plurality of batteries 44. A pair of conductive wires 100 are respectively soldered to said conductive terminals 711, 721 through a solder 700, and are connected to the external circuit 4.

The first and second button parts 2, 3 respectively have first and second conductive members 71, 72A and first and second magnetic regions 73, 74 which attract magnetically each other when the first and second button parts 2, 3 are brought close to each other. The terminals 711, 721A are respectively connected to the first and second conductive members 71, 72A. The first and second conductive members 71, 72 are in contact to each other when the fist and second magnetic regions 73, 74 attract each other.

The first conductive member 71 includes a conductive first flange 83 that is formed with a recess 830, and a conductive first plate 710 that is mounted on the first flange 83 and that is disposed opposite to the recess 830. The first magnetic region 73 of the first button part 2 is formed in the recess 830. The second conductive member 72 includes a conductive second flange 84 that is formed with a protrusion 840 which is magnetic and which defines the second magnetic region 74 of the second button part 3, and a conductive second plate 720 that is mounted on the second flange 84 and that is disposed opposite to the protrusion 840. The terminals 711, 721 project respectively from peripheries of the first and second plates 710, 720. The protrusion 840 extends into the recess 830 and enables contact between the first and second flanges 83, 84 when the first and second magnetic regions 73, 74 attract each other.

The first conductive member 71 further includes a conductive U-shaped plate 831 secured to the first flange 83 and having a pair of arms 8311 extending through the first plate 710 for mounting of the first plate 710 on the first flange 83 and connected to a first disc 21. The second conductive member 72 further includes a conductive U-shaped plate 841 secured to the second flange 84 and having a pair of arms 8411 extending through the second plate 720 for mounting of the second plate 720 on the second flange 84 and connected to a second disc 11.

Figure 14:
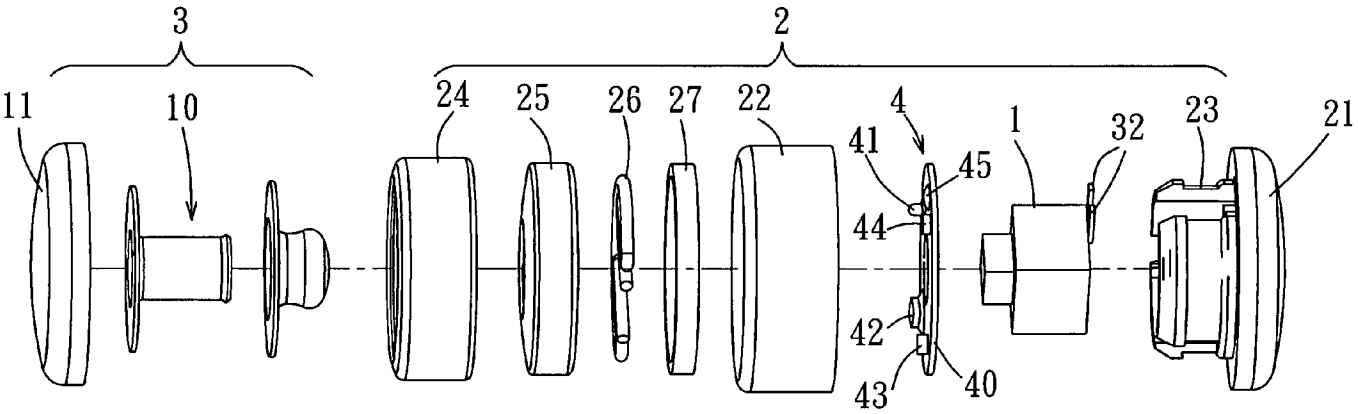
FIG. 14 is an exploded perspective view of the preferred embodiment of a button fastening device-and-circuit assembly according to this invention.
Figure 15:
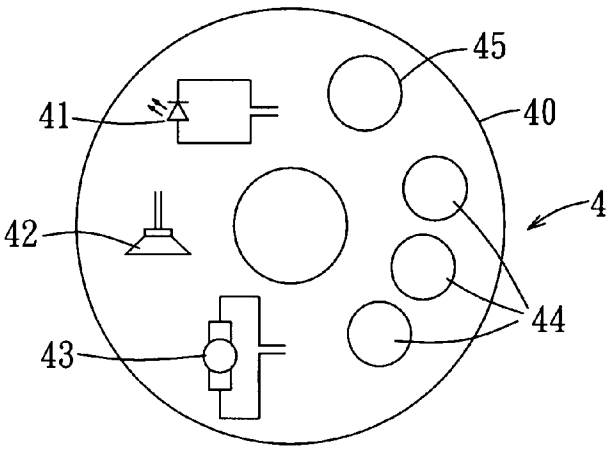
FIG. 15 is a schematic view to illustrate electronic components on a circuit board of the button fastening device-and-circuit assembly of FIG. 14.

FIGS. 14 and 15 illustrate the preferred embodiment of a button fastening device-and-circuit assembly according to this invention. The button fastening device-and-circuit assembly includes a button fastening device that has first and second button parts 2, 3 similar to those of the first preferred embodiment shown in FIG. 3A.

The button fastening device-and-circuit assembly further includes an internal circuit 4 built in the first button part 2. The first and second button parts 2, 3 are coupled to the internal circuit 4 in such a manner that circuit states of the internal circuit 4 are controlled through engagement and disengagement of the first and second button parts 2, 3.

In this embodiment, the circuit 4 is built in a circuit board 40 that is mounted in the first button part 2 adjacent to the circuit actuating unit 1 such that the first and second conductive members 32 on the switch of the circuit actuating unit 1 are connected to the internal circuit 4 through conductive contacts (not shown). The circuit actuating unit 1 is operable through engagement and disengagement of the first and second button parts 2, 3 to control electrical connection and disconnection between the first and second conductive members 32. Note that operation of the circuit actuating unit 1 is the same as that of first preferred embodiment shown in FIG. 3A. Alternatively, the circuit 4 can be disposed externally of the first and second button parts 2, 3, as best shown in FIG. 13.

With the inclusion of the circuit actuating unit 1 in the button fastening device of this invention and with the inclusion of the circuit 4 in the button fastening device-and-circuit assembly of this invention, the attractiveness and consumer appeal of the bag 5 to which the button fastening device and the circuit 4 are attached are significantly enhanced.

With the invention thus explained, it is apparent that various modifications and variations can be made without departing from the spirit of the present invention.

What is claimed is:

1. A button fastening device with circuit actuating capability, comprising:

a first button part;

a second button part engageable releasably with said first button part for fastening articles together; and a circuit actuating unit provided on at least one of said first and second button parts, adapted to be electrically connected to a circuit, and operable to control circuit states of the circuit through engagement and disengagement of said first and second button parts;

wherein said circuit actuating unit includes first and second conductive members which are adapted to be connected to the circuit, said circuit actuating unit being operable through engagement and disengagement of said first and second button parts to control electrical connection and disconnection between said first and second conductive members;

wherein said first button part defines an inner space therein, said first and second conductive members being mounted in said inner space, said second button part having a protrusion that is associated with said first and second conductive members in such a manner that extension of said protrusion into said inner space and removal of said protrusion from said inner space enable electrical connection and disconnection between said first and second conductive members; and wherein said first button part is provided with a retaining member that is mounted in said inner space and that includes a pair of opposite spring arms, said protrusion of said second button part being resiliently clamped by said spring arms when said second button part engages said first button part.

2. The button fastening device of claim 1, wherein said circuit actuating unit is in the form of a switch, said switch having a pressable button, said first and second conductive members being electrically connected to each other through said pressable button when said first and second button parts are disengaged from each other, said pressable button being pressed by said protrusion of said second button part to disconnect said first and second conductive members when said second button part engages said first button part.

3. A button fastening device with circuit actuating capability, comprising:

a first button part;

a second button part engageable releasably with said first button part for fastening articles together; and a circuit actuating unit provided on at least one of said first and second button parts, adapted to be electrically connected to a circuit, and operable to control circuit states of the circuit through engagement and disengagement of said first and second button parts;

wherein said circuit actuating unit includes first and second conductive members which are adapted to be connected to the circuit, said circuit actuating unit being operable through engagement and disengagement of said first and second button parts to control electrical connection and disconnection between said first and second conductive members;

wherein said first button part defines an inner space therein, said first and second conductive members being mounted in said inner space, said second button part having a protrusion that is associated with said first and second conductive members in such a manner that extension of said protrusion into said inner space and removal of said protrusion from said inner space enable electrical connection and disconnection between said first and second conductive members; and wherein said protrusion has a free end that is provided with a conductive cap, said first and second conductive members being spaced apart from each other, each of said first and second conductive members being in the form of a wire, said conductive cap contacting said first and second conductive members when said second button part engages said first button part.

4. The button fastening device of claim 3, wherein said circuit actuating unit further includes a wire-mounting seat that is mounted in said inner space, and that has a ring defining a ring-circled space, each of said first and second conductive members being supported on said ring and having a portion disposed in said ring-circled space, said conductive cap being sleeved on said protrusion and extending into said ring-circled space to contact said first and second conductive members when said second button part engages said first button part.

5. A button fastening device with circuit actuating capability, comprising:

a first button part;

a second button part engageable releasably with said first button part for fastening articles together; and a circuit actuating unit provided on at least one of said first and second button parts, adapted to be electrically connected to a circuit, and operable to control circuit states of the circuit through engagement and disengagement of said first and second button parts;

wherein said circuit actuating unit includes first and second conductive members which are adapted to be connected to the circuit, said circuit actuating unit being operable through engagement and disengagement of said first and second button parts to control electrical connection and disconnection between said first and second conductive members;

wherein said first button part defines an inner space therein, said first and second conductive members being mounted in said inner space, said second button part having a protrusion that is associated with said first and second conductive members in such a manner that extension of said protrusion into said inner space and removal of said protrusion from said inner space enable electrical connection and disconnection between said first and second conductive members; and wherein said circuit actuating unit further includes a circuit board that is mounted in said inner space, each of said first and second conductive members being in the form of a conductive trace that is printed on said circuit board, said protrusion having a free end provided with a conductive cap that is sleeved on said protrusion and that extends to said circuit board to contact said first and second conductive members when said second button part engages said first button part.

6. A button fastening device with circuit actuating capability, comprising:

a first button part;

a second button part engageable releasably with said first button part for fastening articles together; and a circuit actuating unit provided on at least one of said first and second button parts, adapted to be electrically connected to a circuit, and operable to control circuit states of the circuit through engagement and disengagement of said first and second button parts;

wherein said circuit actuating unit includes first and second conductive members which are adapted to be connected to the circuit, said circuit actuating unit being operable through engagement and disengagement of said first and second button parts to control electrical connection and disconnection between said first and second conductive members;

wherein said first button part defines an inner space therein, said first and second conductive members being mounted in said inner space, said second button part having a protrusion that is associated with said first and second conductive members in such a manner that extension of said protrusion into said inner space and removal of said protrusion from said inner space enable electrical connection and disconnection between said first and second conductive members; and wherein said protrusion is magnetic, said circuit actuating unit being in the form of a reed switch, said reed switch having a tube, each of said first and second conductive members being in the form of a reed, extending into said tube, and having a contact end, said contact ends of said first and second conductive members being magnetized and attracting each other to establish contact therebetween upon extension of said protrusion into said inner space when said second button part engages said first button part.

7. A button fastening device with circuit actuating capability, comprising:

a first button part;

a second button part engageable magnetically with said first button part for fastening articles together; and a pair of conductive terminals provided respectively on said first and second button parts and adapted to be electrically coupled to a circuit;

wherein said conductive terminals are electrically connected to each other when said first button part engages magnetically said second button part, thereby activating the circuit; and wherein said first and second button parts respectively have first and second conductive members and first and second magnetic regions which attract magnetically each other when said first and second button parts are brought close to each other, said terminals being respectively connected to said first and second conductive members, said first and second conductive members being in contact to each other when said first and second magnetic regions attract each other.

8. The button fastening device of claim 7, further comprising a pair of conductive wires that are respectively soldered to said conductive terminals.

9. The button fastening device of claim 7, wherein said first conductive member includes a conductive first flange that is formed with a recess, and a conductive first plate that is mounted on said first flange and that is disposed opposite to said recess, said first magnetic region of said first button part being formed in said recess, said second conductive member including a conductive second flange that is formed with a protrusion which is magnetic and which defines said second magnetic region of said second button part, and a conductive second plate that is mounted on said second flange and that is disposed opposite to said protrusion, said terminals projecting respectively from peripheries of said first and second plates, said protrusion extending into said recess and enabling contact between said first and second flanges when said first and second magnetic regions attract each other.

10. The button fastening device of claim 9, wherein said first conductive member further includes a conductive U-shaped plate secured to said first flange and having a pair of arms extending through said first plate for mounting of said first plate on said first flange, said second conductive member further including a conductive U-shaped plate secured to said second flange and having a pair of arms extending through said second plate for mounting of said second plate on said second flange.

11. A button fastening device-and-circuit assembly comprising:

a button fastening device including a first button part, a second button part engageable releasably with said first button part for fastening articles together; and a circuit; and a circuit actuating unit that is mounted in said first button part, that includes first and second conductive members connected to said circuit, and that is operable through engagement and disengagement of said first and second button parts to control electrical connection and disconnection between said first and second conductive members;

wherein said first and second button parts are coupled to said circuit in such a manner that circuit states of said circuit are controlled through engagement and disengagement of said first and second button parts; and wherein said second button part is formed with a protrusion, said circuit actuating unit being in the form of a switch, said first and second conductive members being formed on said switch, said switch having a pressable button, said first and second conductive members being electrically connected to each other through said pressable button when said first and second button parts are disengaged from each other, said pressable button being pressed by said protrusion of said second button part to disconnect said first and second conductive members upon extension of said protrusion into said first button part when said second button part engages said first button part.

12. The button fastening device-and-circuit assembly of claim 11, wherein said circuit is built in said first button part.

13. The button fastening device-and-circuit assembly of claim 11, further comprising a circuit board mounted in said first button part, said circuit being built on said circuit board.

14. A button fastening device-and-circuit assembly comprising:

a button fastening device including a first button part, and a second button part engageable releasably with said first button part for fastening articles together; and a circuit;

wherein said first and second button parts are coupled to said circuit in such a manner that circuit states of said circuit are controlled through engagement and disengagement of said first and second button parts; and wherein said circuit is disposed externally of said first and second button parts.

* * * * *